US006293129B1

(12) United States Patent
Gurevich

(10) Patent No.: US 6,293,129 B1
(45) **Date of Patent: *Sep. 25, 2001**

(54) MULTI-STONE CENTER SETTING FOR DIAMONDS AND GEMSTONES

(75) Inventor: Zelik Gurevich, New York, NY (US)

(73) Assignee: Orion Diamond Inc., New York, NY (US)

( * ) Notice: Subject to any disclaimer, the term of this patent is extended or adjusted under 35 U.S.C. 154(b) by 0 days.

This patent is subject to a terminal disclaimer.

(21) Appl. No.: 09/500,508

(22) Filed: Feb. 9, 2000

(51) Int. Cl.[7] ..... A44C 17/02

(52) U.S. Cl. ..... 63/28; 63/26; 63/27; D11/91; D11/92

(58) Field of Search ..... 63/26, 27, 28, 63/29.1; D11/89, 90, 91, 92

(56) References Cited

U.S. PATENT DOCUMENTS

| | | | | |
|---|---|---|---|---|
| D. 80,898 | * | 4/1930 | Kaufman | D11/92 |
| D. 386,443 | | 11/1997 | Itzkowitz . | |
| D. 387,302 | | 12/1997 | Itzkowitz . | |
| D. 388,015 | | 12/1997 | Itzkowitz . | |
| D. 388,016 | | 12/1997 | Kejejian . | |
| D. 388,017 | | 12/1997 | Kejejian . | |
| D. 400,121 | | 10/1998 | Ambar . | |
| D. 403,611 | | 1/1999 | Lai . | |
| D. 411,134 | | 6/1999 | Lai . | |
| D. 425,817 | * | 5/2000 | Gurevich et al. | D11/91 |
| 2,207,869 | * | 7/1940 | Monnier | 63/32 |
| 2,733,579 | * | 2/1956 | Pfeffer et al. | 63/29.1 |
| 2,907,187 | * | 10/1959 | Karp et al. | 63/28 |
| 5,123,265 | | 6/1992 | Ramot . | |
| 5,520,017 | | 5/1996 | Vivat . | |
| 5,848,539 | | 12/1998 | Ouzounian . | |
| 6,003,335 | * | 12/1999 | Gurevich et al. | 63/26 |

FOREIGN PATENT DOCUMENTS

| | | | | |
|---|---|---|---|---|
| 585940 | * | 3/1925 | (FR) | 63/28 |
| 802367 | * | 9/1936 | (FR) | 63/28 |

* cited by examiner

*Primary Examiner*—B. Dayoan
*Assistant Examiner*—Andrea Chop
(74) *Attorney, Agent, or Firm*—Ezra Sutton

(57) ABSTRACT

The multi-stone setting for nine gemstones or diamonds includes a rectangular-shaped setting having a four-sided frame member with first and second parallel lower crossbars extending in a first direction and in the same plane, and first and second parallel upper crossbars extending in a second direction perpendicular to the first direction, and in a different plane. The first and second lower crossbars and the first and second upper crossbars form nine seats each for receiving one of nine gemstones or diamonds. The multi-stone setting includes four corners with four corner prongs mounted on the four corners, respectively. Each of the four corner prongs have a V-shaped configuration forming a right angle for engaging the four corner gemstones.

20 Claims, 13 Drawing Sheets

MULTI-STONE CENTER SETTING FOR DIAMONDS AND GEMSTONES

FIELD OF THE INVENTION

The present relates to a multi-stone center setting for holding therein nine (9) or twelve (12) rectangular-shaped or square-shaped gemstones (princess cut gemstones) in which the combined gemstone aggregate gives a larger appearance than that of a single gemstone of a similar carat weight. More particularly, this multi-stone center setting having nine to twelve gemstones therein gives the appearance that the setting is substantially invisible.

BACKGROUND OF THE INVENTION

Invisible gemstone settings are well known in the art and refers to a setting for gemstones in which the setting lies beneath the visible surface of the gemstones. Typically, to invisibly set a large number of gemstones, the approach of the prior art has been to notch the gemstones and to mount them in a setting having two or more parallel walls, with metallic projections, for example, prongs or the like, protruding from these walls for engaging the notches. Generally, these walls define channels in which the gemstones are set abutting one another in accordance with the invisible mounting method.

Invisible gemstone settings for jewelry products suffer from a number of disadvantages. First, casting of a jewelry item with a gemstone region including a recess and walls and preparing T-shaped cross bars is a relatively difficult and therefore costly process. Second, the assembly of the jewelry item requires considerable time of a skilled worker which adds greatly to the overall cost of the jewelry item. And third, the finished jewelry item cannot be readily downsized without disturbing the invisible gemstone setting.

Therefore, there remains a need for a novel invisible and multiple gemstone setting for jewelry ornaments which overcomes the disadvantages of conventional multi-stone and invisible gemstone settings for jewelry items. The multi-stone center setting would include a rectangular-shaped or square-shaped metal setting for holding nine to twelve princess cut gemstones in which the combined gemstone aggregate gives a larger appearance than that of a single gemstone of a similar carat weight. Additionally, the multi-stone center setting would give the appearance that the setting (metal) is essentially invisible to the eye of the wearer.

DESCRIPTION OF THE PRIOR ART

Invisible gemstone settings, multi-gemstone settings, jewelry settings and the like having various designs, structures, configurations and functions have been disclosed in the prior art. For example, U.S. Pat. No. 5,848,539 to OUZOUNIAN discloses an invisible, multiple precious stone setting for mounting two or more rows of round-shaped precious stones. This prior art patent does not disclose the structure and configuration of the present invention.

U.S. Pat. No. 5,520,017 to VIVAT discloses jewelry items with invisible gemstone settings, wherein the gemstone setting includes a least two walls so as to provide at least one groove. The groove slidably receives one or more rectangularly-shaped precious stones therein. This prior art patent does not disclose the structure and configuration of the present invention.

U.S. Pat. No. 5,123,265 to RAMOT discloses an invisible gemstone setting, wherein the gemstone setting assembly includes one or more gemstones and a setting having a base formed with a plurality of ribs defining one or more sockets of polygonal configuration for receiving the gemstones. This prior art patent does not disclose the structure and configuration of the present invention.

U.S. Design Pat. No. D403,611 to LAI discloses an ornamental design for a jewelry setting having a square-shaped grid pattern for square-shaped gemstones. This prior art patent does not disclose the structure and configuration of the present invention.

None of the aforementioned prior art patents disclose or teach the multi-stone center setting of the present invention for receiving therein nine or twelve rectangular-shaped or square-shaped gemstones which gives the appearance of a single gemstone by essentially giving the setting an invisible profile.

Accordingly, it is an object of the present invention to provide a multi-stone setting for holding therein nine or twelve rectangular-shaped or square-shaped gemstones in which the combined aggregate of the nine or twelve gemstones give a larger appearance than that of a single gemstone of a similar carat weight (i.e., a 2.4 carat presentation of the combined nine or twelve gemstones appears as large as a 4.0 carat gemstone, as the present invention would have a larger table).

Another object of the present invention is to provide a multi-stone setting having nine or twelve gemstones therein that is less expensive than a single gemstone of a similar carat weight (i.e., the 2.4 carat presentation of the combined nine or twelve gem-stones is less expensive than an actual 2.4 carat single gemstone of the same carat weight).

Another object of the present invention is to provide a multi-stone setting having nine or twelve princess cut gemstones therein which gives the appearance that the setting is substantially invisible at distances greater than 12 inches from the jewelry product.

Another object of the present invention is to provide a multi-stone setting that can be varied in size depending upon the total combined carat weight of the nine or twelve gemstones within the setting.

Another object of the present invention is to provide a multi-stone setting that can be made from precious metals such as gold, silver, platinum or palladium for setting precious gemstones including diamonds, rubies, sapphires, emeralds and the like.

Another object of the present invention is to provide a multi-stone setting having nine or twelve gemstones therein for use in personal adornment in the form of ornamental jewelry such as rings, pins, brooches, pendants, clasps, necklaces, bracelets, anklets and earrings.

Another object of the present invention is to provide a multi-stone setting that can be produced in an economical manner and is readily affordable by the jewelry consumer.

SUMMARY OF THE INVENTION

In accordance with the preferred embodiment of the present invention, there is provided a multi-stone setting having nine gemstones or diamonds. The multi-stone setting includes a rectangular-shaped setting having a four-sided frame member with a first lower crossbar extending in a first direction and a second lower crossbar being parallel and in the same plane to the first lower crossbar and also extending in the first direction.

The rectangular-shaped setting also has a first upper crossbar having first insert tabs extending in a second direction perpendicular to the first direction and a second upper crossbar having second insert tabs being parallel and in the same plane to the first upper crossbar and also extending in the second direction. The first and second lower crossbars are located in a different plane than the first and second upper crossbars.

The first and second lower crossbars and the first and second upper crossbars form nine seats each for receiving one of nine gemstones or diamonds. The first and second lower crossbars and the first and second upper crossbars define two outer rows of seats to form six outer seats and one inner row of three seats for receiving the nine gemstones, in order to form a first outer row of gemstones, a second outer row of gemstones, and an inner row of gemstones, and the first and second outer rows of gemstones forming four outer gemstones, each of the four outer gemstones having side walls.

The first outer row of gemstones include a first set of inner side walls for engaging the first upper crossbar, the first set of inner side walls has grooves formed therein for seating the first outer row of gemstones on the first insert tabs of the first upper crossbar.

The second outer row of gemstones include a second set of inner side walls for engaging the second upper crossbar, the second set of inner side walls has grooves formed therein for seating the second outer row of gemstones on the second insert tabs of the second upper crossbar.

The inner row of gemstones include first inner side walls for engaging the first upper crossbar and second inner side walls for engaging the second upper crossbar. The first and second inner side walls have grooves formed therein for seating the inner row of gemstones on the first and second insert tabs of the first and second upper crossbars, respectively.

The multi-stone setting includes four corners with four corner prongs mounted on the four corners, respectively. Each of the four corner prongs have a V-shaped configuration forming a right angle for engaging two side walls of one of the four outer gemstones in the first and second outer rows of gemstones. The four corner prongs engage the four outer gemstones respectively to keep the four outer gemstones seated within the four outer seats of the multi-stone setting.

In an alternate embodiment of the present invention, there is provided a multi-stone setting having twelve gemstones or diamonds therein. The multi-stone setting includes a rectangular-shaped setting having a four-sided frame member with a first lower crossbar extending in a first direction; a second lower crossbar being parallel and in the same plane to the first lower crossbar and also extending in the first direction; and a third lower crossbar being parallel and in the same plane to the first and second lower crossbars and also extending in the first direction.

The rectangular-shaped setting also has a first upper crossbar having first insert tabs extending in a second direction perpendicular to the first direction and a second upper crossbar having second insert tabs being parallel an in the same plane to the first upper crossbar and also extending in the second direction. The first, second and third lower crossbars are located in a different plane than the first and second upper crossbars.

The first, second and third lower crossbars and the first and second upper crossbars form twelve seats each for receiving one of twelve gemstones or diamonds. The first, second and third lower crossbars and the first and second upper crossbars define two outer rows of seats to form eight outer seats and one inner row of four seats for receiving the twelve gemstones, to form a first outer row of gemstones, a second outer row of gemstones, and an inner row of gemstones. The first and second outer rows of gemstones forming four outer gemstones, each of the four outer gemstones having side walls.

The first outer row of gemstones includes a first set of inner side walls for engaging the first upper crossbar, the first set of inner side walls having grooves formed therein for seating the first outer row of gemstones on the first insert tabs of the first upper crossbar.

The second outer row of gemstones includes a second set of inner side walls for engaging the second upper crossbar, the second set of inner side walls having grooves formed therein for seating the second outer row of gemstones on the second insert tabs of the second upper crossbar.

The inner row of gemstones includes first inner side walls for engaging the first upper crossbar and second inner side walls for engaging the second upper crossbar. The first and second inner side walls having grooves formed therein for seating the inner row of gemstones on the first and second insert tabs of the first and second upper crossbars, respectively.

The multi-stone setting includes four corners with four corner prongs mounted on the four corners, respectively. Each of the four corner prongs have a V-shaped configuration forming a right angle for engaging two side walls of one of the four outer gemstones in the first and second outer rows of gemstones. The four corner prongs engage the four outer gemstones respectively to keep the four outer gemstones seated within the four outer seats of the multi-stone setting.

BRIEF DESCRIPTION OF THE DRAWINGS

Further objects, features, and advantages of the present invention will become apparent upon the consideration of the following detailed description of the presently-preferred embodiment when taken in conjunction with the accompanying drawings, wherein.

DETAILED DESCRIPTION OF THE PREFERRED EMBODIMENT 10

Figure 1:
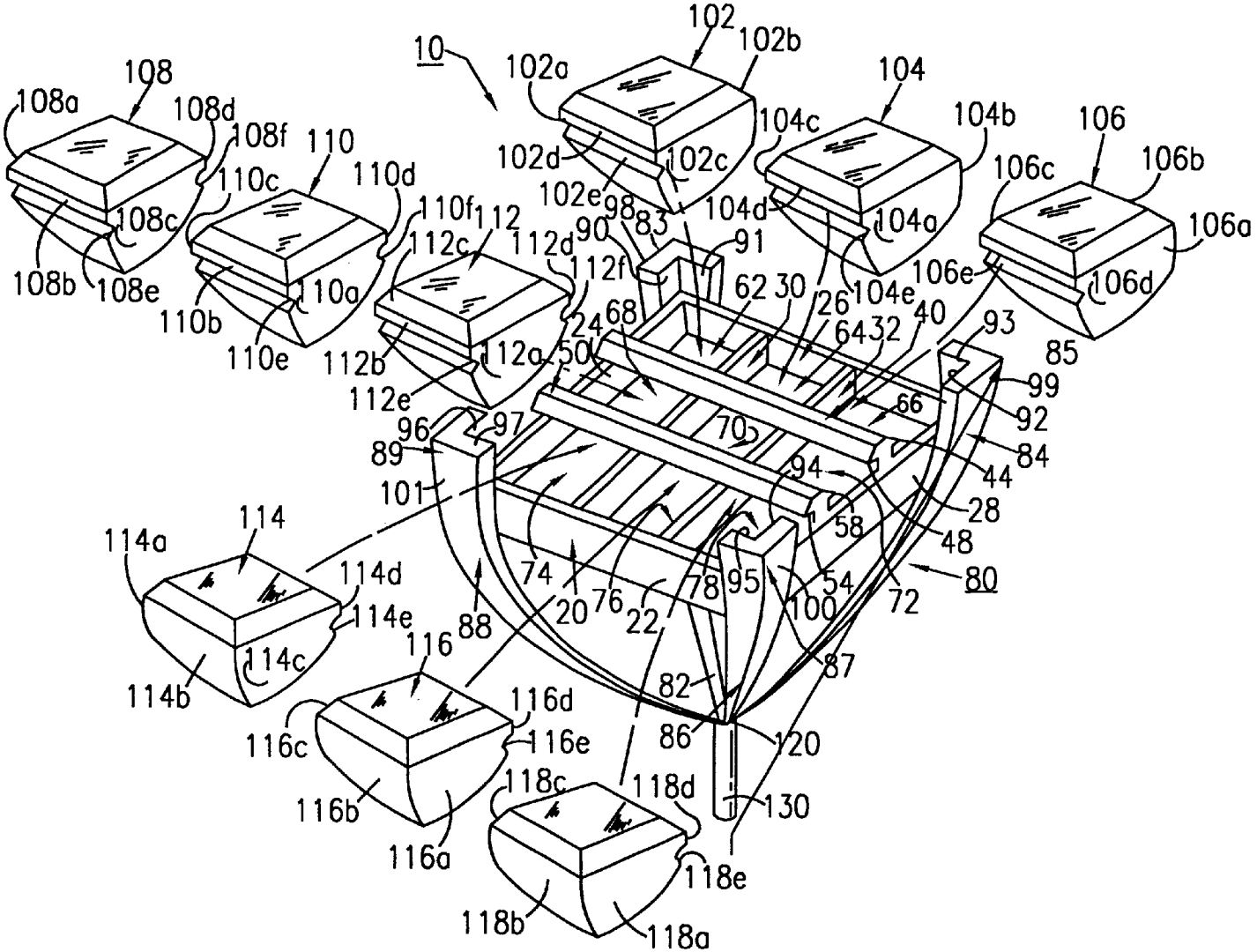
FIG. 1 is a top perspective view of the multi-stone center setting for holding nine gemstones or diamonds of the preferred embodiment of the present invention.

The multi-stone setting 10 and its component parts of the alternate embodiment of the present invention are represented in detail by FIGS. 1 through 10A and 10B of the patent drawings. The multi-stone setting 10 is used for holding in place nine (9) rectangular-shaped or square-shaped diamonds 102, 104, 106, 108, 110, 112, 114, 116 and 118 with each diamond 102 to 118 having four side walls 102*a* to 102*d*, 104*a* to 104*d*, 106*a* to 106*d*, 108*a* to 108*d*, 110*a* to 110*d*, 112*a* to 112*d*, 114*a* to 114*d*, 116*a* to 116*d* and 118*a* to 118*d*, respectively. The multi-stone setting 10, as shown in FIG. 1 of the drawings, includes a rectangular-shaped gemstone setting 10 having an upper frame member 20, a curved corner section assembly 80 and a setting connecting bar member 130.

Figure 2:
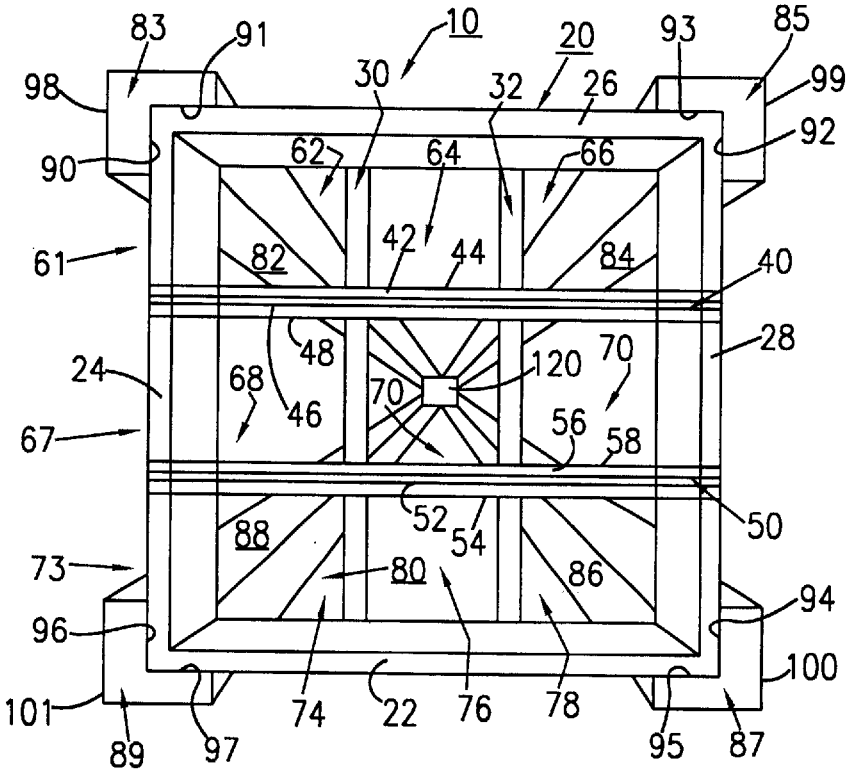
FIG. 2 is a top plan view of the multi-stone setting of the present invention shown in FIG. 1.
Figure 3:
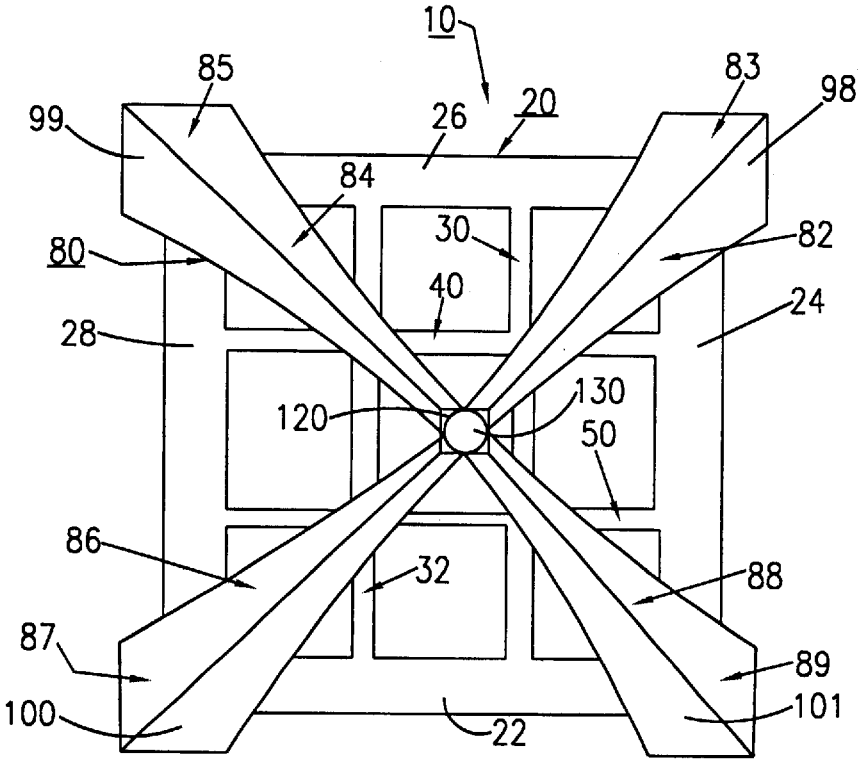
FIG. 3 is a bottom plan view of the multi-stone setting of the present invention shown in FIG. 1.
Figure 4:
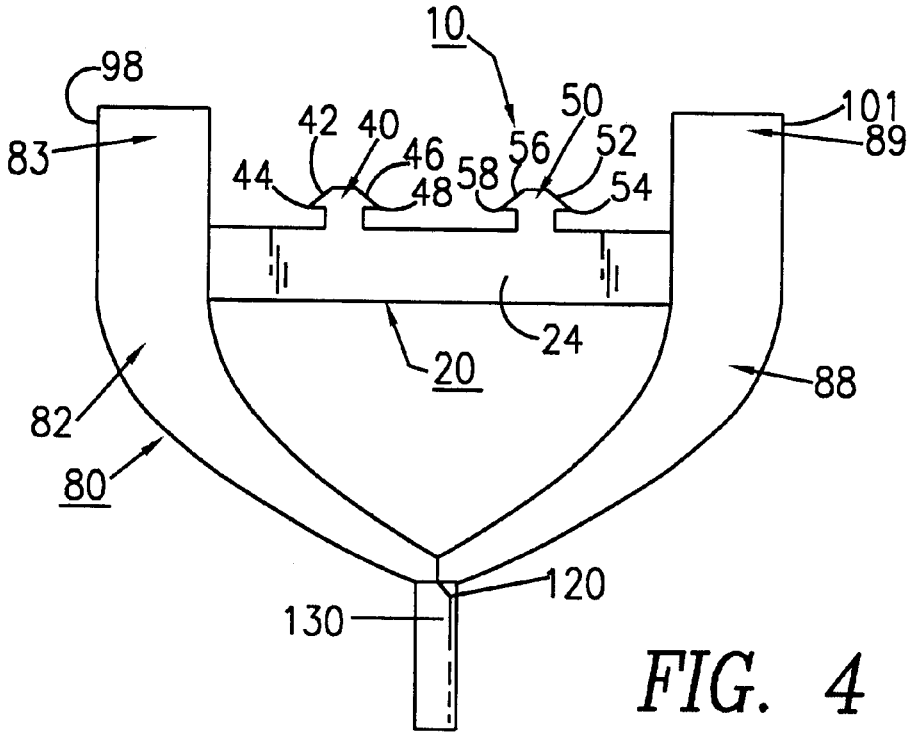
FIG. 4 is a side elevational view of the multi-stone setting of the present invention shown in FIG. 1.
Figure 5:
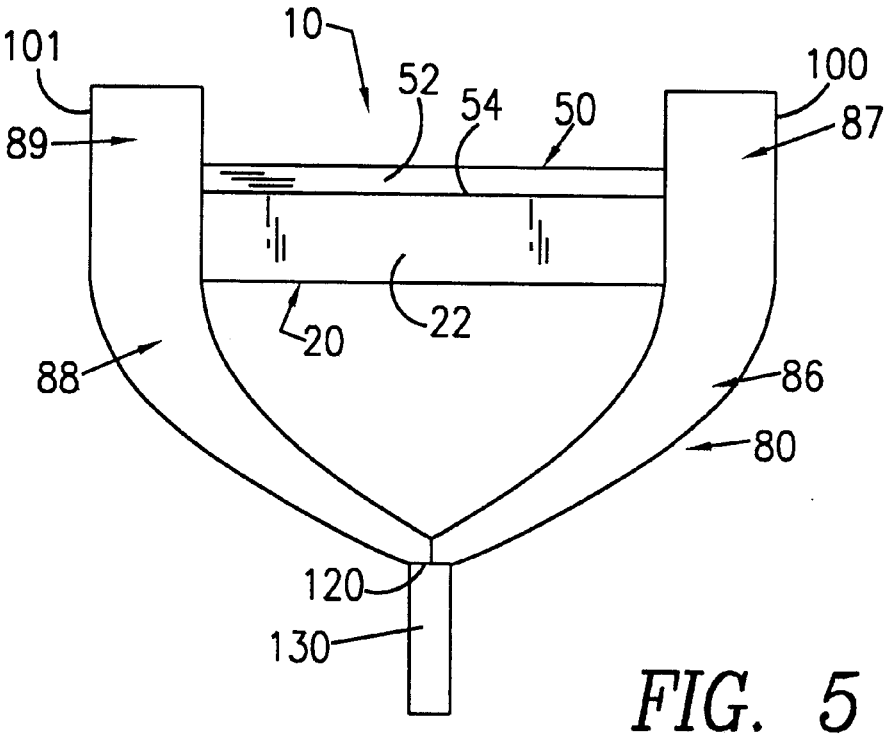
FIG. 5 is a front elevational view of the multi-stone setting of the present invention shown in FIG. 1.

The upper frame member 20 includes four side frame members 22, 24, 26 and 28; a first lower crossbar 30 and a second lower crossbar 32 connected to the two opposing side frame members 22 and 26, both lower crossbars 30 and 32 are being equally spaced-apart and parallel with each other; and first and second upper crossbars 40 and 50 being equally spaced-apart and parallel with each other and are mounted on top of the first and second lower crossbars 30 and 32, respectively. The first and second upper crossbars 40 and 50 are connected to the other two opposing side frame members 24 and 28. The first and second lower crossbars 30 and 32 and the first and second upper crossbars 40 and 50 are used for forming nine seats 62, 64, 66, 68, 70, 72, 74 and 78 having a rectangular or square shape, as shown in FIGS. 1 and 2 of the drawings. Each of the nine seats 62 to 78 are used to retain and hold in place diamonds 102 to 118, respectively, such that the first and second lower crossbars 30 and 32 and the first and second upper crossbars 40 and 50 define two outer rows 61 and 73 of seats (first outer row 61 includes seats 62, 64 and 66 and the second outer row 73 includes seats 74, 76 and 78), and one inner row 67 of seats (inner row 67 includes seats 68, 70 and 72) for receiving the nine diamonds 102 to 118 therein. Additionally, the first and second lower crossbars 30 and 32 extend in a first direction, the first and second upper crossbars 40 and 50 extend in a second direction perpendicular to the first direction. The first and second upper crossbars 40 and 50 are parallel to each other and also extend in the second direction, as shown in FIG. 2 of the drawings. The first upper crossbar 40 includes a first wall surface 42 having a first retaining insert edge member 44 thereon, and also includes a second wall surface 46 having a second retaining insert edge member 48 thereon. The second upper crossbar 50 includes a first wall surface 52 having a first retaining insert edge member 54 thereon, and also includes a second wall surface 56 having a second retaining insert edge member 58 thereon.

The first outer row 61 includes diamonds 102, 104 and 106 having grooved slots 102*e*, 104*e* and 106*e* formed on their respective side walls 102*d*, 104*d* and 106*d*, respectively, wherein grooved slots 102*e*, 104*e* and 106*e* of diamonds 102, 104 and 106 engage the first retaining insert edge member 44 of the first upper crossbar 40 for nesting and seating the first outer row 61 of diamonds 102, 104 and 106 on the first upper crossbar 40, as shown in FIG. 1 of the drawings. The second outer row 73 includes diamonds 114, 116 and 118 having grooved slots 114*e*, 116*e* and 118*e* formed on their respective side walls 114*d*, 116*d* and 118*d*, respectively, wherein grooved slots 114*e*, 116*e* and 118*e* of diamonds 114, 116 and 118 engage the first retaining insert edge member 54 of the second upper crossbar 50 for nesting and seating the second outer row 73 of diamonds 114, 116 and 118 on the second upper crossbar 50, as shown in FIG. 1 of the drawings. The inner row 67 includes diamonds 108, 110 and 112 having grooved slots 108*e* and 108*f*, 110*e* and of, and 112*e* and 112*f* formed on their opposite side walls 108*b* and 108*d*, 110*b* and 110*d*, and 112*b* and 112*d*, respectively, wherein grooved slots 108*f*, 110f and 112*f* of diamonds 108, 110 and 112 engage the second retaining insert edge member 48 of the first upper crossbar 40 for nesting and seating of side walls 108*d*, 110*d* and 112*d* of diamonds 108, 110 and 112 on the first upper crossbar 40. Also, grooved slots 108*e*, 110*e* and 112*e* of diamonds 108, 110 and 112 engage the second retaining insert edge member 58 of the second upper crossbar 50 for nesting and seating of side walls 108*b*, 110*b* and 112*b* of diamonds 108, 110 and 112 on the second upper crossbar 50, as depicted in FIG. 1 of the drawings.

Figure 8:
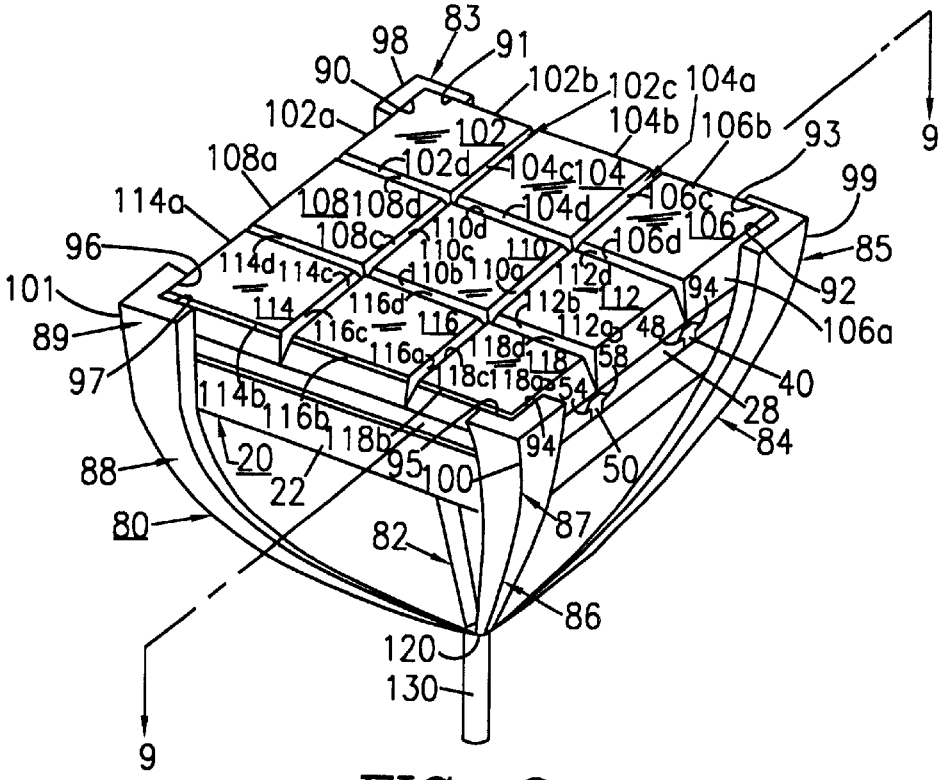
FIG. 8 is a top perspective view of the multi-stone setting of the present invention showing nine square-shaped diamonds seated within the four seats of the gemstone setting.
Figure 10A:
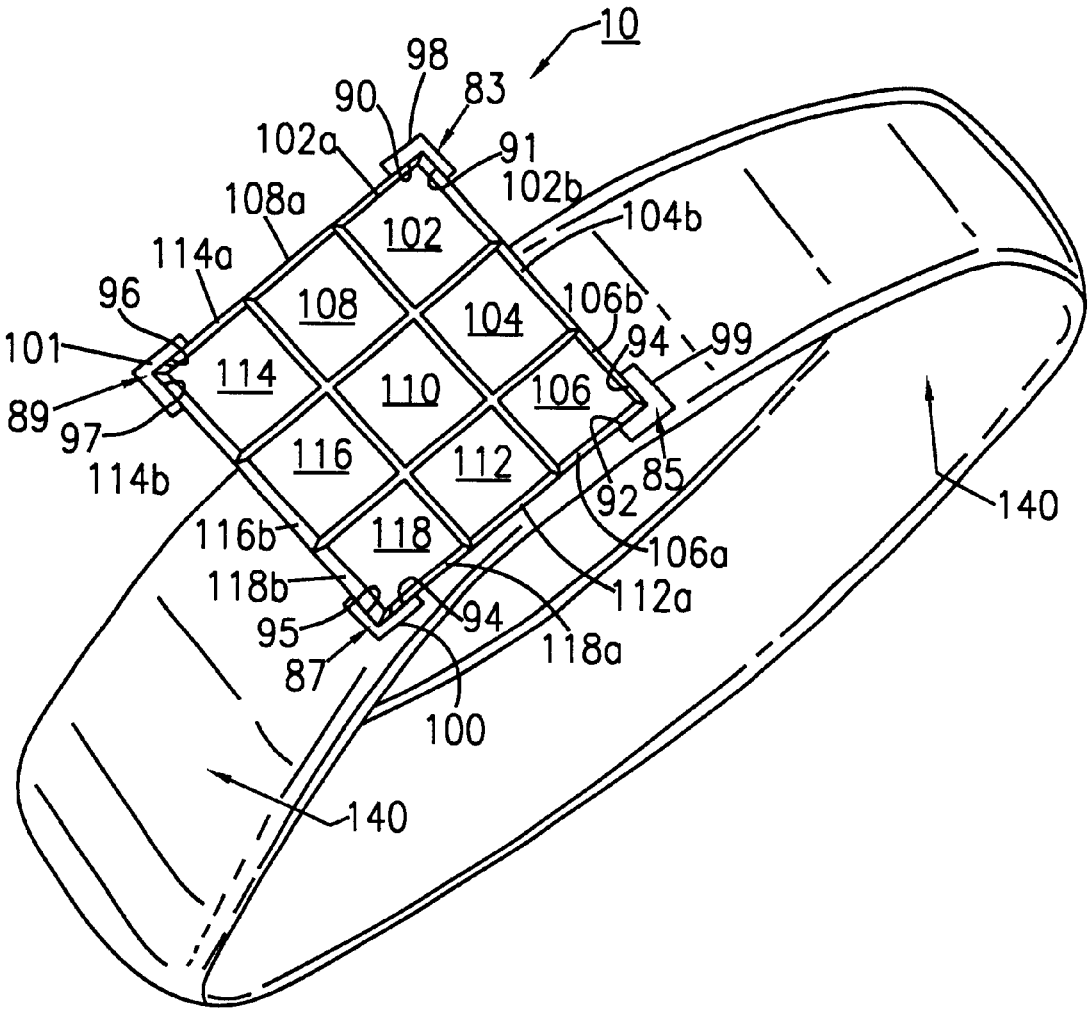
FIG. 10A is a top perspective view of the multi-stone setting of the present invention showing nine square-shaped diamonds seated within the nine seats of the gemstone setting and being connected to a ring holding member to form a diamond ring.
Figure 10B:
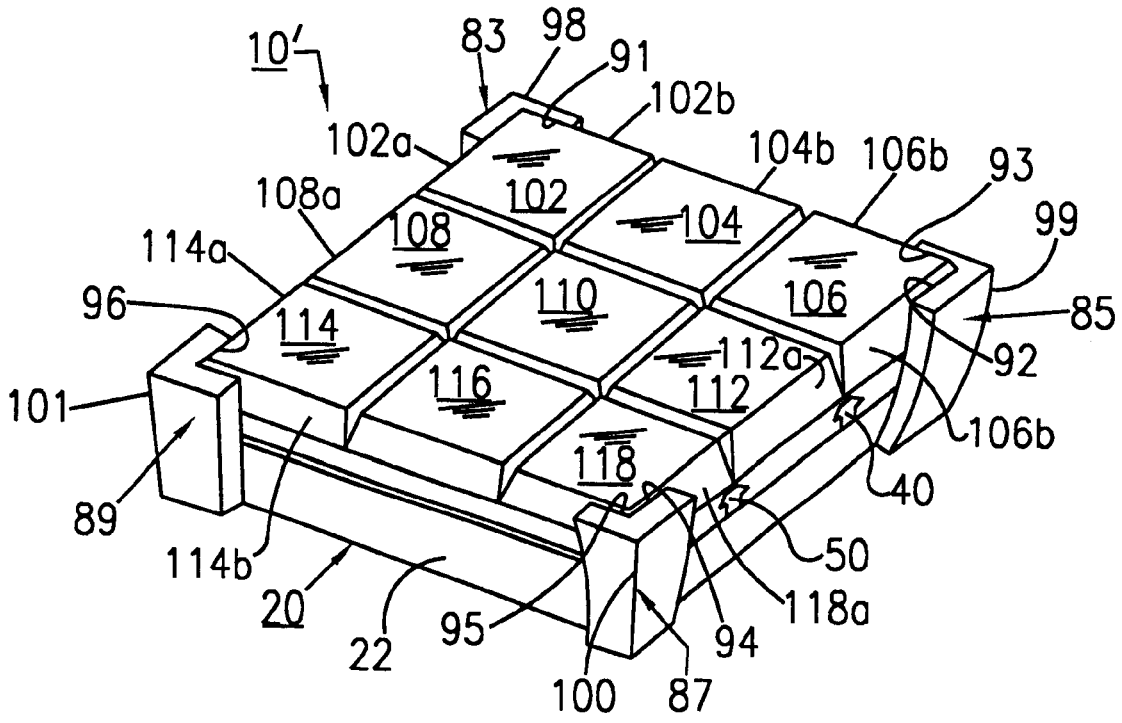
FIG. 10B is a top perspective view of the multi-stone setting of the present invention showing nine rectangular-shaped diamonds seated within the nine seats of the setting for forming a pin.

The curved corner section assembly 80, as shown in FIGS. 1, 8 and 10 of the drawings, includes four corner section members 82, 84, 86 and 88 having upper V-shaped prong holding members 83, 85, 87 and 89, respectively, thereon. Each V-shaped configuration of prong holding members 83, 85, 87 and 89 is formed into a right angle (90°) configuration, as shown in FIG. 1. Each prong holding member 83, 85, 87 and 89 includes first and second retaining wall members 90, 91; 92, 93; 94, 95; 96 and 97, respectively, for engaging and holding two side walls of each of the outer rows of diamonds 102, 106, 114 and 118, respectively. First and second retaining wall members 90 and 91 of prong 83 engage side walls 102*a* and 102*b* of diamond 102, respectively. First and second retaining wall members 92 and 93 of prong 85 engage side walls 106*a* and 106*b* of diamond 106, respectively. First and second retaining wall members 94 and 95 of prong 87 engage side walls 118*a* and 118*b* of diamond 118, respectively. First and second retaining wall members 96 and 97 of prong 89 engage side walls 114*a* and 114*b* of diamond 114, respectively. The four corner prong holding members 83, 85, 87 and 89 further include upper ends 98, 99, 100 and 101, respectively, wherein the upper ends 98, 99, 100 and 101 are higher than the four side frame members 22 to 28 of frame member 20 for directly engaging the respective side walls of the outer row diamonds 102, 106, 118 and 124, respectively, as depicted in FIGS. 1, 8, 10A and 10B of the drawings.

Each of the curved corner section members 82 to 88 of corner section assembly 80 are integrally connected and joined together at the bottom end point 120, as shown in FIGS. 1, 3, 4 and 5 of the drawings. The setting connecting bar member 130 is also integrally attached at the bottom end point 120. Connecting bar member 130 is used for attachment to a ring member 140 or other jewelry products such as pins, brooches, pendants, necklaces, bracelets, anklets and earrings, as shown in FIG. 10A of the drawings.

An alternate embodiment of the gemstone setting 10' and its component parts of the present invention is represented in detail by FIG. 10B of the patent drawings. All aspects of this alternate embodiment 10' are the same as the preferred embodiment of the gemstone setting 10, except there is no bottom end point nor a connecting bar member. This alternate embodiment 10' can be used in making of such jewelry products like pins, pendants, necklaces and brooches, etc.

The gemstone setting 100 can be made of gold, silver, platinum, palladium, or other precious metals. Gemstone setting 10 or 10' can also be made into different size settings depending upon the size (carat weight) of the rectangular-shaped or square-shaped diamonds 102 to 112 being mounted therein. The total carat weight for the nine gemstones or diamonds 102 to 112 typically is in the range of 0.27 to 3.00 carats per gemstone setting 10 or 10'. Additionally, other types of gemstones such as rubies, emeralds and sapphires can be used for the multi-stone setting 10 or 10'of the present invention.

DETAILED DESCRIPTION OF THE ALTERNATE EMBODIMENT 200

Figure 11:
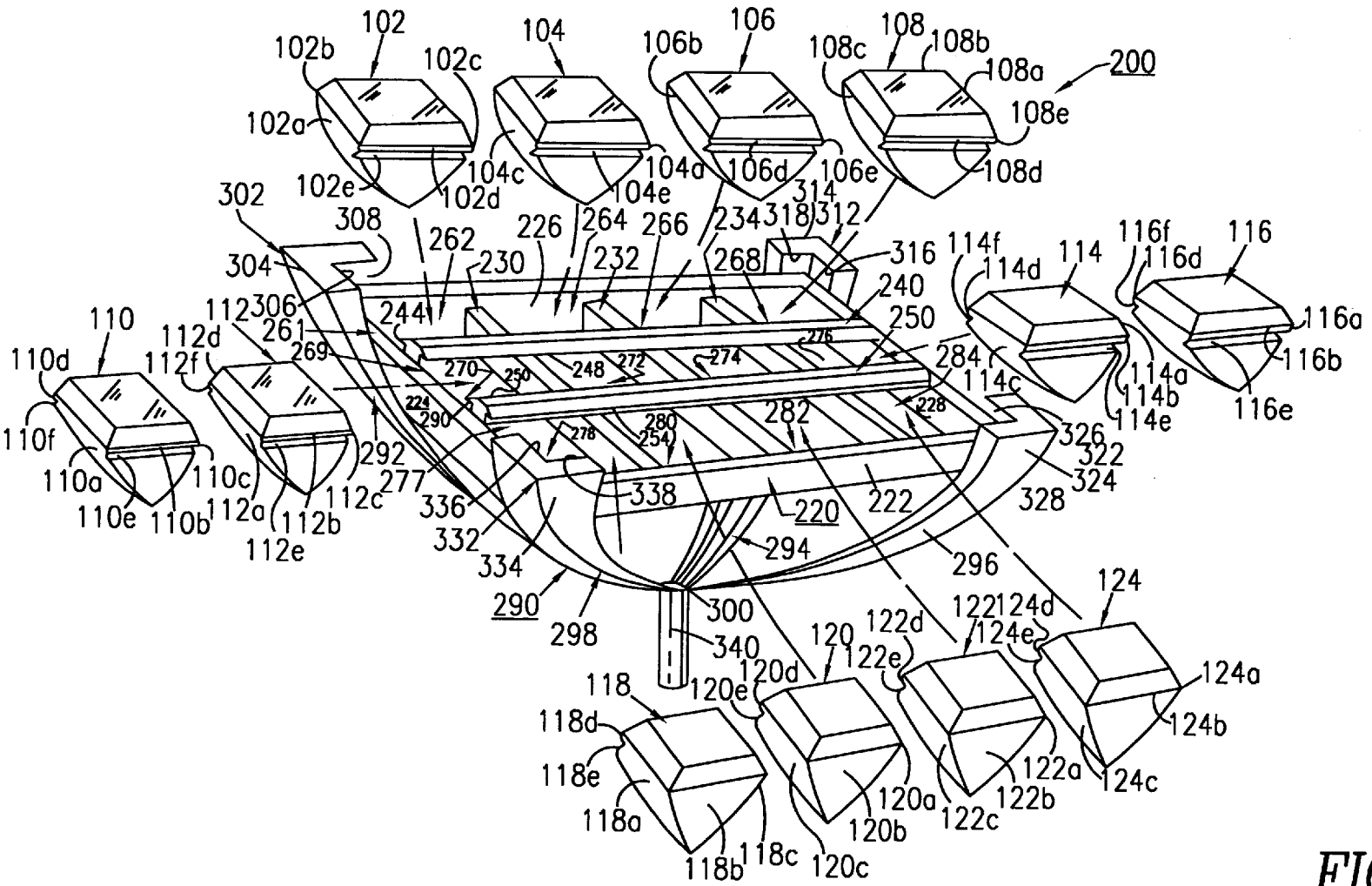
FIG. 11 is a top perspective view of an alternative embodiment of the multi-stone setting for holding twelve gemstones or diamonds of the present invention.

The multi-stone setting 200 and its component parts of the alternate embodiment of the present invention are represented in detail by FIGS. 11 through 18 of the patent drawings. The multi-stone setting 200 is used for holding in place twelve (12) rectangular-shaped or square-shaped diamonds, 102, 104, 106, 108, 110, 112, 114, 116, 118, 120, 122 and 124 with each diamond 102 to 124 having four side walls 102*a* to 102*d*, 104*a* to 104*d*, 106*a* to 106*d*, 108*a* to 108*d*, 110*a* to 110*d*, 112*a* to 112*d*, 114*a* to 114*d*, 116*a* to 116*d*, 118*a* to 118*d*, 120*a* to 120*d*, 122*a* to 122*d* and 124*a* to 124*d*, respectively. The multi-stone setting 200, as shown in FIG. 11 of the drawings, includes a rectangular-shaped gemstone setting 200 having an upper frame member 220, a curved corner section assembly 290, and a setting connecting bar member 340.

Figure 12:
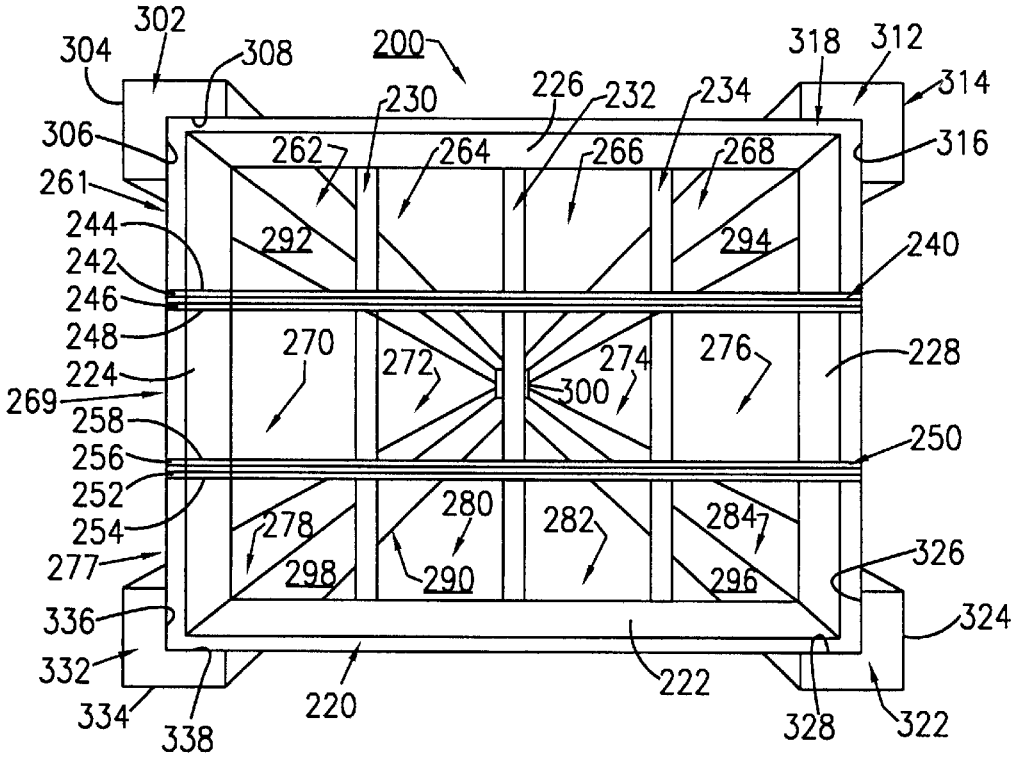
FIG. 12 is a top plan view of the multi-stone setting of the present invention shown in FIG. 11 with the frame member having first, second and third upper crossbars and first and second lower crossbars therein that form twelve seats for receiving twelve rectangular-shape or square-shaped diamonds therein.
Figure 13:
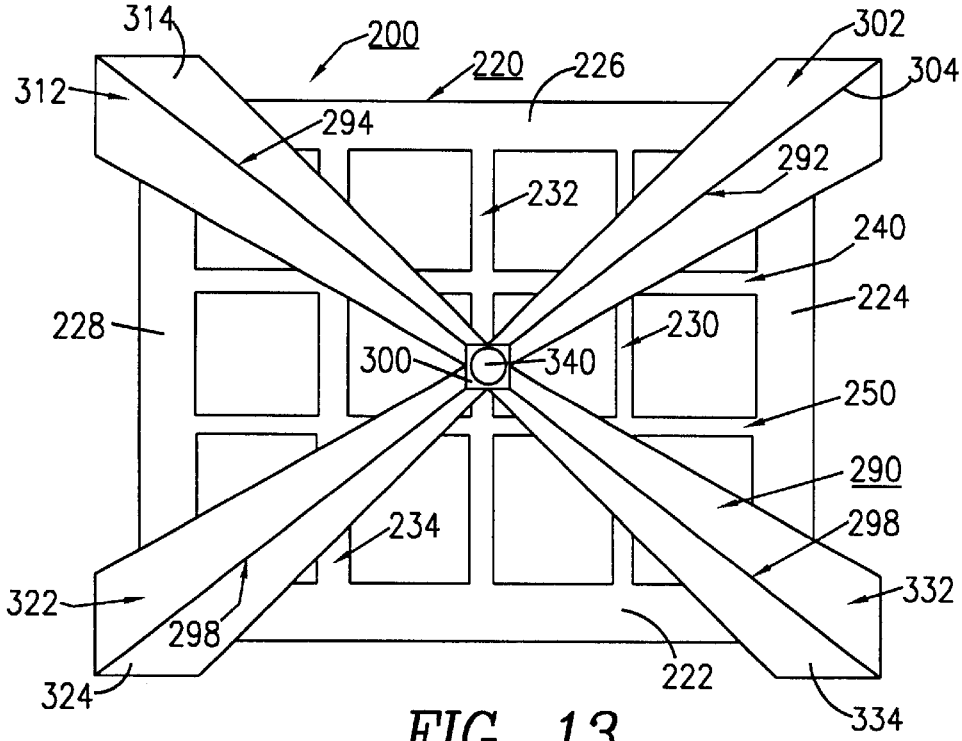
FIG. 13 is a bottom plan view of the multi-stone setting of the present invention shown in FIG. 11.
Figure 14:
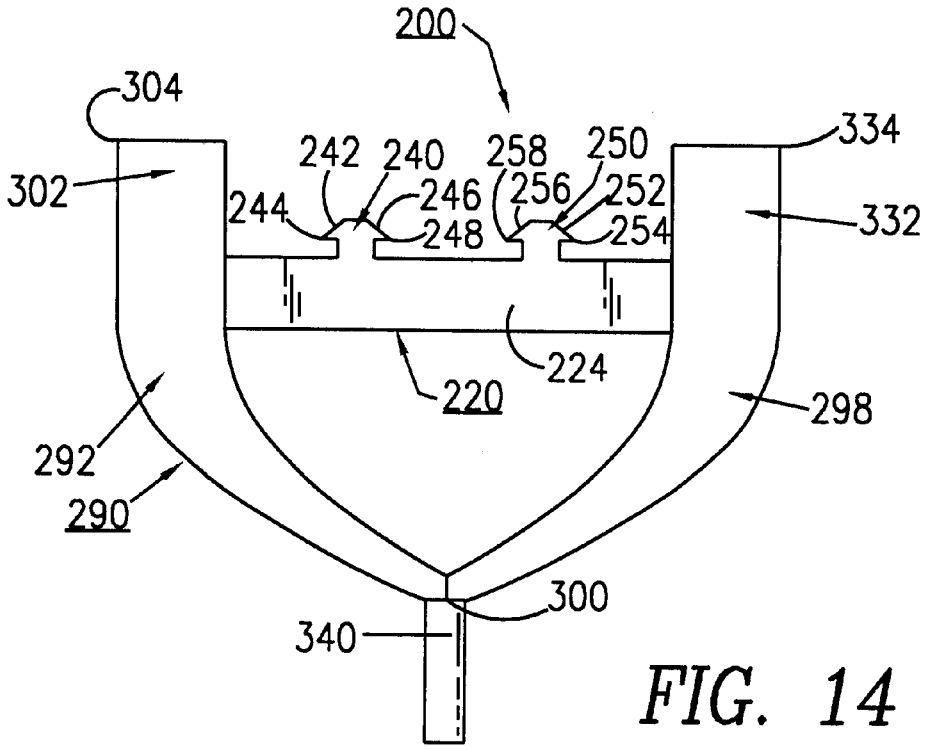
FIG. 14 is a side elevational view of the multi-stone setting of the present invention shown in FIG. 11 showing the first, second and-third upper crossbars.
Figure 15:
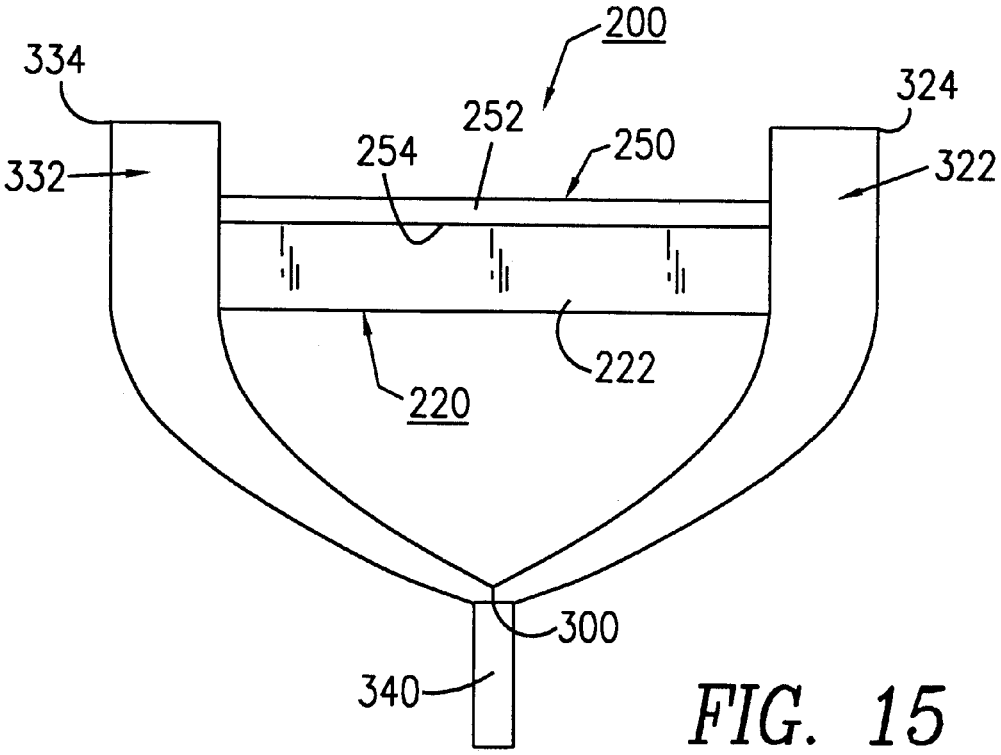
FIG. 15 is a front elevational view of the multi-stone setting of the present invention shown in FIG. 11 showing the second lower crossbar.

The upper frame member 220 includes four side frame members 222, 224, 226 and 228; a first lower crossbar 230, a second lower crossbar 232, and a third lower crossbar 234 connected to the two opposing side frame members 222 and 226. All of the lower crossbars 230, 232 and 234 are equally spaced-apart and parallel with each other. The first and second upper crossbars 240 and 250 are equally spaced-apart and parallel with each other and are mounted on top of the first, second and third lower crossbars 230, 232 and 234, respectively. The first and second upper crossbars 240 and 250 are connected to the other two opposing side frame members 224 and 228. The first, second and third lower crossbars 230, 232 and 234 and the first and second upper crossbars 240 and 250 are used for forming twelve seats 262, 264, 266, 268, 270, 272, 274, 276, 278, 280, 282 and 284 having a rectangular or square shape, as shown in FIGS. 11 and 12 of the drawings. Each of the twelve seats 262 to 284 are used to retain and hold in place diamonds 102 to 124, respectively, such that the first, second and third lower crossbars 230, 232 and 234, and the first and second upper crossbars 240 and 250 define two outer rows 261 and 277 of seats (first outer row 261 includes seats 262, 264, 266 and 268 and the second outer row 277 includes seats 278, 280, 282 and 284), and one inner row 269 of seats (inner row 269 includes seats 270, 272, 274 and 276) for receiving the twelve diamonds 102 to 124 therein. Additionally, the first, second and third lower crossbars 230, 232 and 234 extend in a first direction, the first and second upper crossbars 240 and 250 extend in a second direction perpendicular to the first direction. The first and second upper crossbars 240 and 250 are parallel to each other and also extend in the second direction, as shown in FIG. 12 of the drawings. The first upper crossbar 240 includes a first wall surface 242 having a first retaining insert edge member 244 thereon, and also includes a second wall surface 246 having a second retaining insert edge member 248 thereon. The second upper crossbar 250 includes a first wall surface 252 having a first retaining insert edge member 254 thereon, and also includes a second wall surface 256 having a second retaining insert edge member 258 thereon.

The first outer row 261 includes diamonds 102, 104, 106 and 108 having grooved slots 102*e*, 104*e*, 106*e* and 108*e* formed on their respective side walls 102*d*, 104*d*, 106*d* and 108*d*, respectively, wherein grooved slots 102*e*, 104*e*, 106*e* and 108*e* of diamonds 102, 104, 106 and 108 engage the first retaining insert edge member 244 of the first upper crossbar 240 for nesting and seating the first outer row 261 of diamonds 102, 104, 106 and 108 on the first upper crossbar 240, as shown in FIG. 11 of the drawings. The second outer row 277 includes diamonds 118, 120, 122 and 124 having grooved slots 118*e*, 120*e*, 122*e* and 124*e* formed on their respective side walls 118*d*, 120*d*, 122*d* and 124*d*, respectively, wherein grooved slots 118*e*, 120*e*, 122*e* and 124*e* of diamonds 118, 120, 122 and 124 of the first retaining insert edge member 254 of the second upper crossbar 250 for nesting and seating the second outer row 277 of diamonds 118, 120, 122 and 124 on the second upper crossbar 250, as shown in FIG. 11 of the drawings. The inner row 269 includes diamonds 110, 112, 114 and 116 having grooved slots 110*e* and 110*f*, 112*e* and 112*f*, 114*e* and 114*f*, and 116*e* and 116*f* formed on their opposite side walls 110*b* and 110*d*, 112*b* and 112*d*, 114*b* and 114*d* and 116*b* and 116*d*, respectively, wherein grooved slots 110*f*, 112*f*, 114*f* and 116*f* of diamonds 110, 112, 114 and 116 engage the second retaining insert edge member 248 of the first upper crossbar 240 for nesting and seating of side walls 110*d*, 112*d*, 114*d* and 116*d* of diamonds 110, 112, 114 and 116 on the first upper crossbar 240. Also, grooved slots 110*e*, 112*e*, 114*e* and 116*e* of diamonds 110, 112, 114 and 116 engage the second retaining insert edge member 258 of the second upper crossbar 250 for nesting and seating of side walls 110*b*, 112*b*, 114*b* and 116*b* of diamonds 110, 112, 114 and 116 on the second upper crossbar 250, as depicted in FIG. 11 of the drawings.

Figure 16:
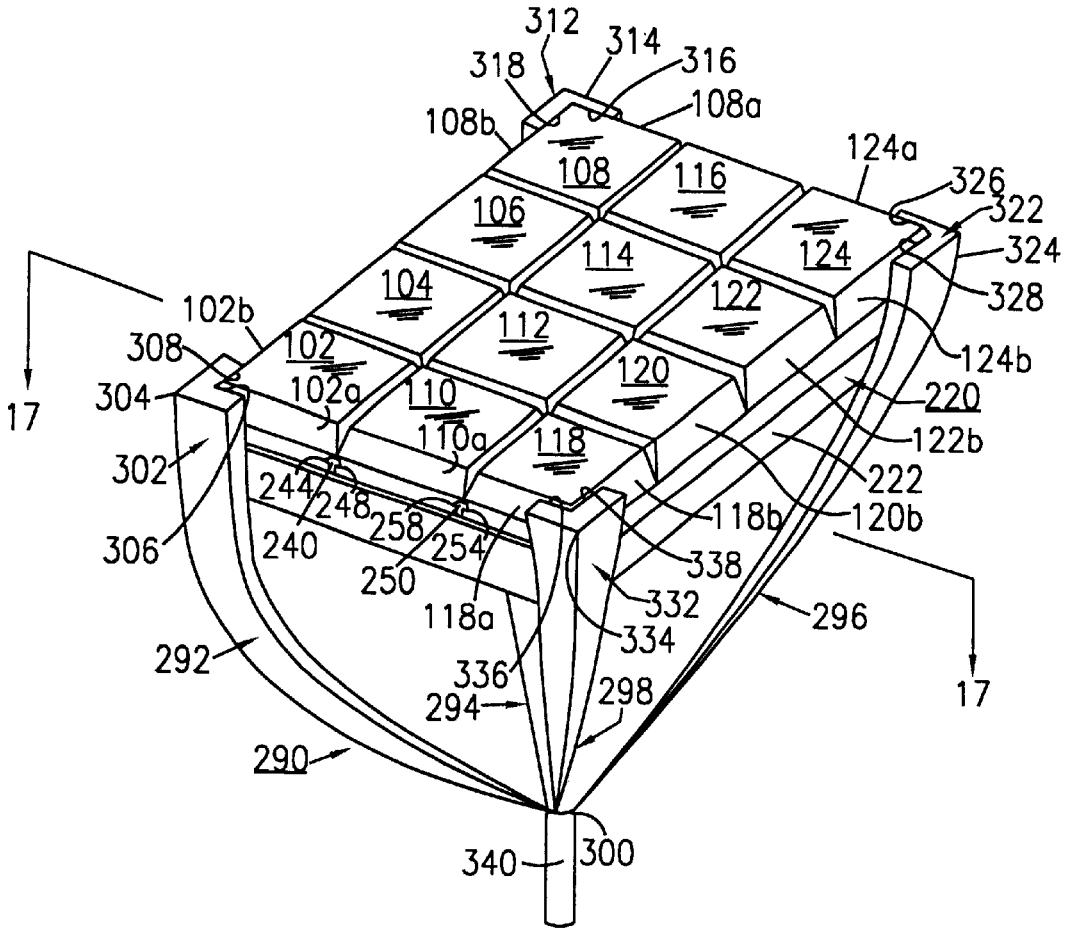
FIG. 16 is a top perspective view of the multi-stone setting of the present invention shown in FIG. 11 showing twelve square-shaped diamonds seated within the twelve seats of the setting.
Figure 18:
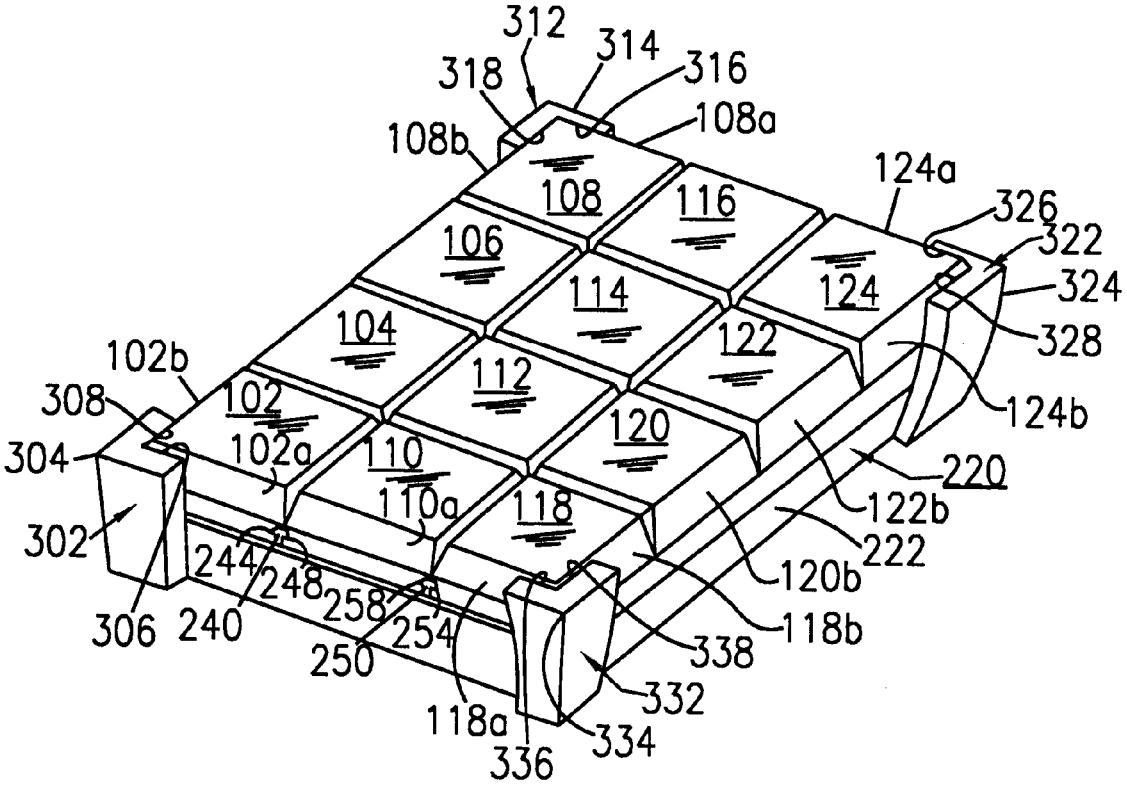
FIG. 18 is a top perspective view of the multi-stone setting of the present invention showing twelve square-shaped diamonds seated within the twelve seats of the rectangular-shaped setting for forming a clasp.
Figure 19:
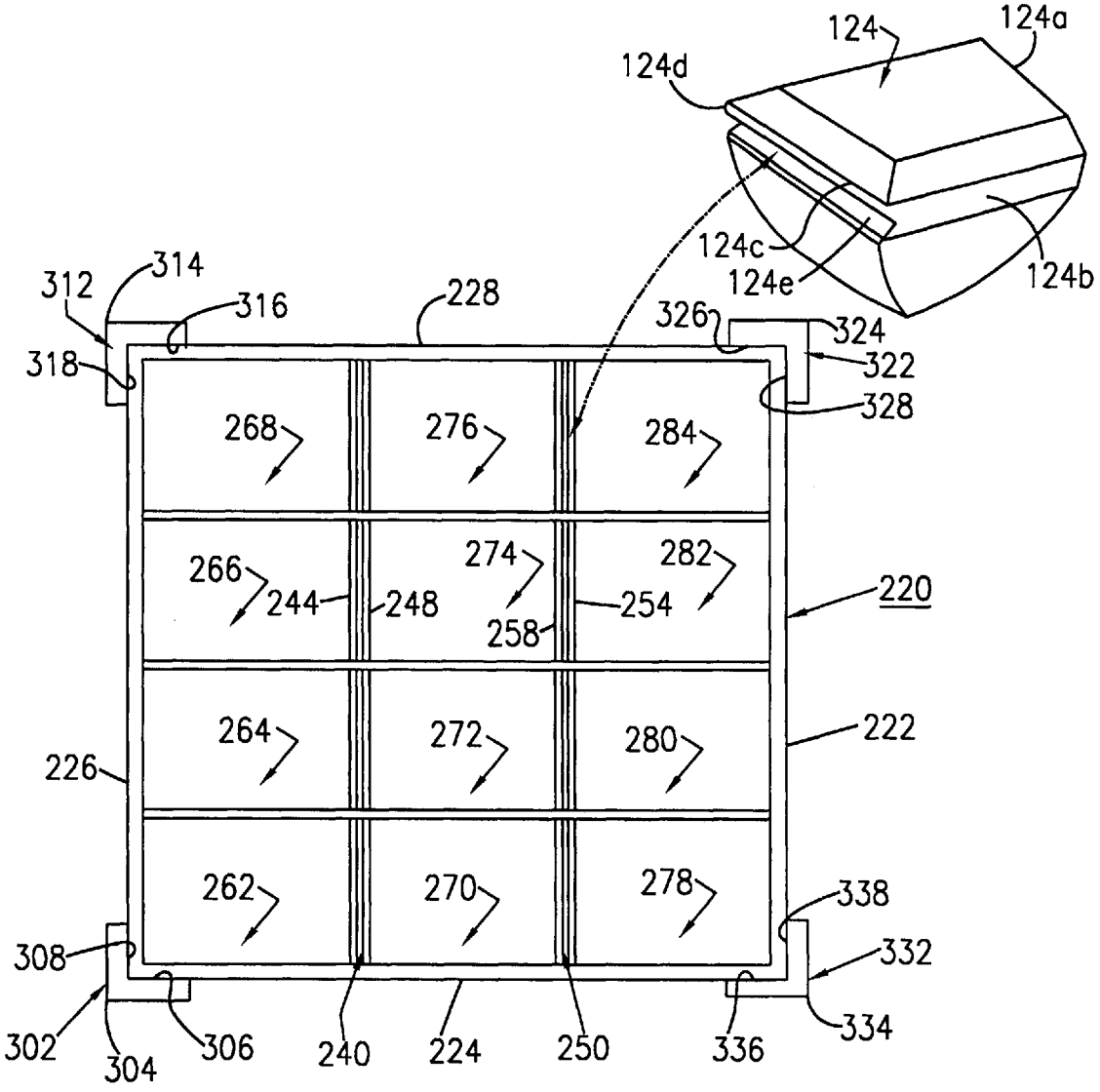
FIG. 19 is a partial perspective view of the multi-stone setting of the present invention showing a rectangular-shaped diamond being seated within a rectangular-shaped seat of the square-shaped setting for forming a clasp.

The curved corner section assembly 290, as shown in FIGS. 11, 16 and 18 of the drawings, includes four corner section members 292, 294, 296 and 298 having upper V-shaped prong holding members 302, 312, 322 and 332 is formed into a right angle (90°) configuration, as shown in FIGS. 11 and 12 of the drawings. Each prong holding member 302, 312, 322 and 332 includes first and second retaining wall members 306, 308; 316, 318; 326, 328; 336 and 338; respectively, for engaging and holding two side walls of the outer rows 261 and 277 of diamonds 102, 104, 106, 108, 118, 120, 122 and 124, respectively. First and second retaining wall members 306 and 308 of prong 302 engage side walls 102*a* and 102*b* of diamond 102, respectively. First and second retaining wall members 316 and 318 of prong 312 engage side walls 108*a* and 108*b* of diamond 108, respectively. First and second retaining wall members 326 and 328 of prong 322 engage side walls 124*a* and 124*b* of diamond 124, respectively. First and second retaining wall members 336 and 338 of prong 332 engage side walls 118*a* and 118*b* of diamond 118, respectively. The four corner prong holding members 302, 312, 322 and 332 further include upper ends 304, 314, 324 and 334, respectively, wherein the upper ends 304, 314, 324 and 334 are higher than the four side frame members 222 to 228 of upper frame member 220 for directly engaging the respective side walls of each of the outer row of diamonds 102, 108, 118 and 124, respectively, as depicted in FIGS. 11, 16 and 18 of the drawings.

Each of the curved corner section members 292, 294, 296 and 298 of corner section assembly 290 are integrally connected and joined together at the bottom end point 300, as shown in FIGS. 11, 13, 14 and 15 of the drawings. The setting connecting bar member 340 is also integrally attached at the bottom end point 300. Connecting bar member 340 is used for attachment for jewelry products such as rings, pins, brooches, pendants, necklaces, bracelets, anklets, earrings, as shown in FIG. 18 of the drawings.

An alternate embodiment of the gemstone setting 200' and its component parts of the present invention is represented in detail by FIG. 18 of the patent drawings. All aspects of this alternate embodiment 200' are the same as the embodiment of the gemstone setting 200, except there is no bottom end point nor a connecting bar member. This alternate embodiment 200' can be used in making of such jewelry products like brooches, pendants, pins and necklaces, etc.

The gemstone setting 200 or 200' can be made of gold, silver, platinum, palladium, or other precious metals. Gemstone setting 200 or 200' can also be made into different size settings depending upon the size (carat weight) of the rectangular-shaped or square-shaped diamonds 102 to 124 being mounted therein. The total carat weight for the twelve gemstones or diamonds 102 to 124 typically is in the range of 0.36 to 4.00 carats per gemstone setting 200 or 200'. Additionally, other types of gemstones such as rubies, emeralds and sapphires can be used for the multi-stone setting 200 or 200' of the present invention.

OPERATION OF THE PRESENT INVENTION PREFERRED EMBODIMENT 10

Figure 9:
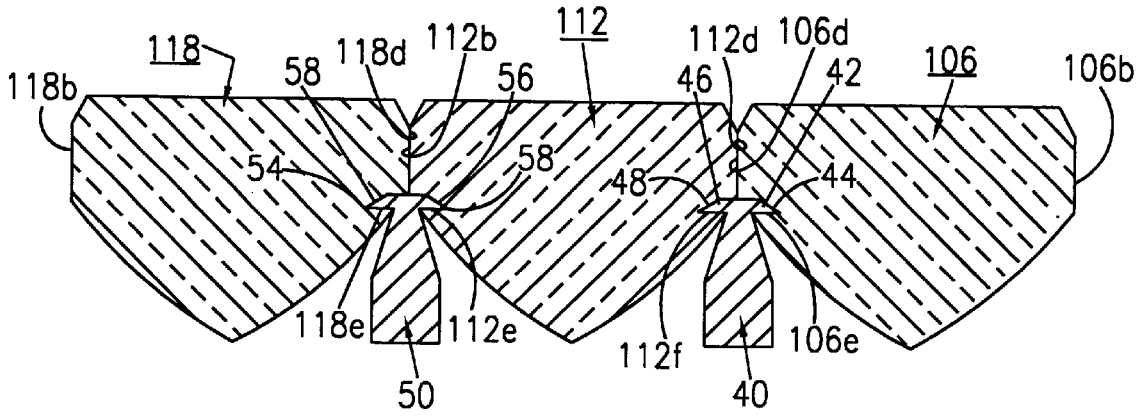
FIG. 9 is a cross-sectional view of the multi-stone setting of the present invention taken along lines 9—9 of FIG. 8 showing the first and second upper crossbars within the cut grooves of three diamonds.

In operation, the multi-stone setting 10 of the preferred embodiment of the present invention, as shown in FIGS. 1 and 8 to 9 of the patent drawings, starts with the jeweler initially mounting the connecting bar member 130 to a jewelry vise (not shown) for the convenient assembly of each of the diamonds 102 to 118 within each of the seats 62 to 78, respectively, of gemstone setting 10 by the jeweler. The jeweler's initial steps are to slidably mount the inner row 61 of diamonds 108, 110 and 112 within seats 68, 70 and 72, respectively, wherein the grooved slots 108*f*, 110*f* and 112*f* in diamonds 108, 110 and 112 nestably engage the second retaining insert edge member 48 of the first upper crossbar 40 for nesting and seating of sidewalls 108*d*, 110*d* and 112*d* of diamonds 108, 110 and 112 on the first upper crossbar 40, respectively, as depicted in FIGS. 1, 6, 7 and 9 of the drawings. Concurrently, the grooved slots 108*e*, 110*e* and 112*e* in diamonds 108, 110 and 112 also nestably engage the second retaining insert edge member 156 of the second upper crossbar 50 for nesting and seating of side walls 108*b*, 110*b* and 112*b* of diamonds 108, 110 and 112 on the second upper crossbar 50, respectively, as depicted in FIGS. 1 and 9 of the drawings.

Figures 6, 7:
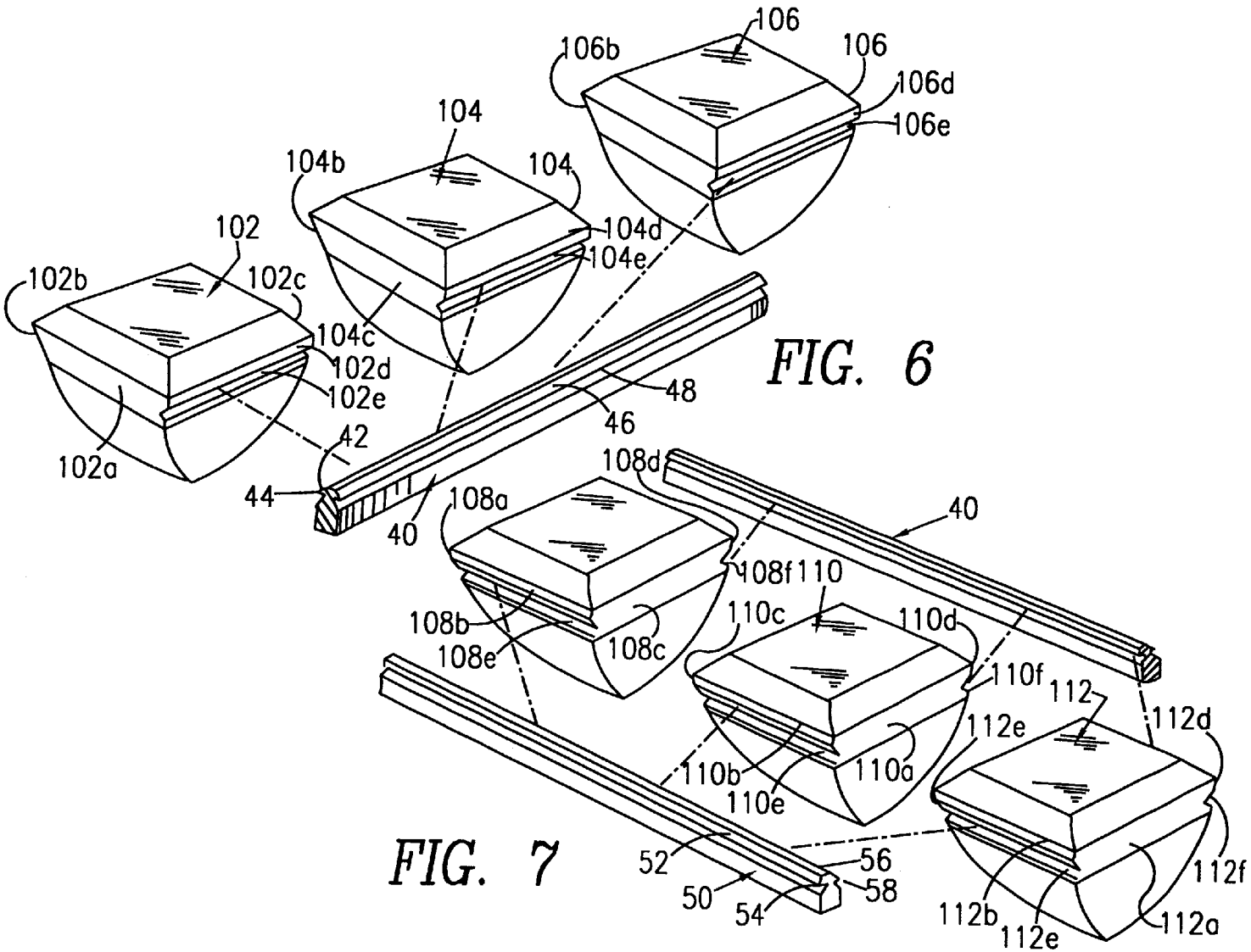
FIG. 6 is a top perspective view of the multi-stone setting of the present invention showing three square-shaped diamonds being slidably connected with the first upper crossbar of the frame member.
FIG. 7 is a top perspective view of the multi-stone setting of the present invention showing three square-shaped diamonds being slidably connected with the first and second upper crossbars of the frame member.

The jeweler's next steps are to slidably set the grooved slots 102*e*, 104*e* and 106*e* in diamonds 102, 104 and 106, respectively, onto the first retaining insert edge member 44 of the first upper crossbar 40, as depicted in FIGS. 1, 6 and 7 of the patent drawings, for nesting and seating of the first outer row 61 of diamonds 102, 104 and 106 on the first upper crossbar 40 within seats 62, 64 and 66, respectively. Then the jeweler slightly bends each of the upper ends 98 and 99 of prong holding members 83 and 85 inwardly to engage diamonds 102 and 106, respectively, such that the retaining wall members 90 and 91 of prong 83 are adjacent to and in contact with the side walls 102*a* and 102*b* of diamonds 102. Also, the retaining wall members 92 and 93 of prong 85 are adjacent to and in contact with the side walls 106*a* and 106*b* of diamond 106 for securely holding in place diamonds 102 and 106 within seats 62 and 66 of the first outer row 61, respectively, of gemstone setting 10.

The jeweler again repeats the aforementioned steps for diamonds 114, 116 and 118 by slidably setting the grooved slots 114*e*, 116*e* and 118*e* in diamonds 114, 116 and 118, respectively, onto the first retaining insert edge member 54 of the second upper crossbar 50, as depicted in FIGS. 1, 6 and 7 of the patent drawings, for nesting and seating of the second outer row 73 of diamonds 114, 116 and 118 on the second upper crossbar 50 within seats 74, 76 and 78, respectively. Then the jeweler slightly bends inwardly each of the upper ends 100 and 101 of prong holding members 87 and 89, respectively, such that the retaining wall members 94 and 95 of prong 87 are adjacent to and in contact with side walls 118*a* and 118*b* of diamond 118. Also, the retaining wall members 96 and 97 of prong 89 are adjacent to and in contact with the side walls 114*a* and 114*b* of diamond 114 for securely holding in place diamonds 114 and 118 within seats 74 and 78 of the second outer row 73, respectively, of gemstone setting 10.

The jeweler's final step is to attach the connecting bar member 130 to a ring holding member 140 to form a finger ring, as shown in FIG. 10A of the drawings.

ALTERNATE EMBODIMENT 200

Figure 17:
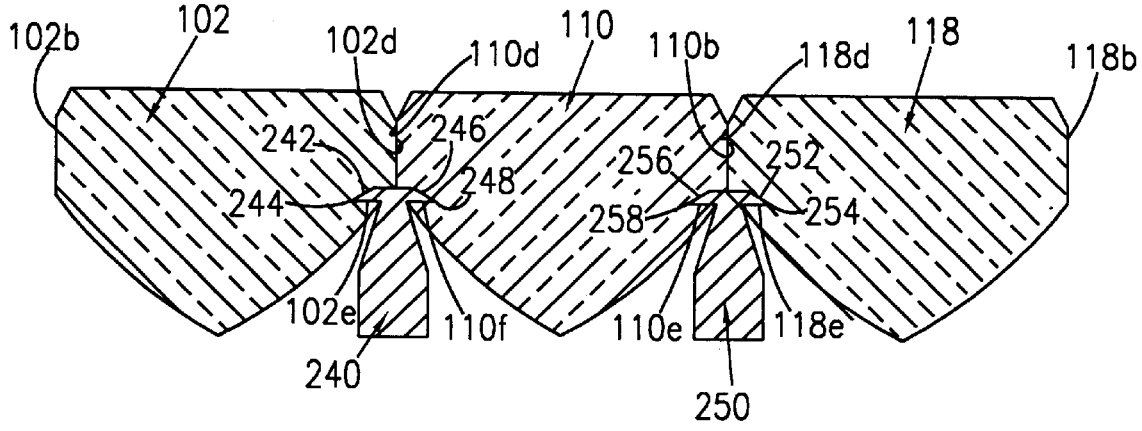
FIG. 17 is a cross-sectional view of the multi-stone setting of the present invention taken along lines 17—17 of FIG. 16 showing the first, second and third upper crossbars within the cut grooves of four diamonds.

In operation, the multi-stone setting 200 of the alternate embodiment of the present invention, as shown in FIGS. 11 and 16 to 18 of the patent drawings, starts with the jeweler initially mounting the connecting bar member 340 to a jewelry vise (not shown) for the convenient assembly of each of the diamonds 102 to 124 within each of the seats 262 to 284, respectively, of gemstone setting 200 by the jeweler. The jeweler's initial steps are to slidably mount the inner row 269 of diamonds 110 and 116 within seats 270, 272, 274 and 276, respectively, wherein the grooved slots 110*f*, 112*f*, 114*f* and 116*f* in diamonds 110, 112, 114 and 116 nestably engage the second retaining insert edge member 248 of the first upper crossbar 240 for nesting and seating of sidewalls 110*d*, 112*d*, 114*d* and 116*d* of diamonds 110, 112, 114 and 116 on the first upper crossbar 142, respectively, as depicted in FIGS. 11 and 17 of the drawings. Concurrently, the grooved slots 110*e*, 112*e*, 114*e* and 116*e* in diamonds 110, 112, 114 and 116 also nestably engage the second retaining insert edge member 258 of the second upper crossbar 250 for nesting and seating of side walls 110*b*, 112*b*, 114*b* and 116*b* of diamonds 110, 112, 114 and 116 on the second upper crossbar 250, respectively, as depicted in FIG. 11 of the drawings.

The jeweler's next steps are to slidably set the grooved slots 102*e*, 104*e*, 106*e* and 108*e* in diamonds 102, 104, 106 and 108, respectively, onto the first retaining insert edge member 244 of the first upper crossbar 240, as depicted in FIGS. 11 and 17 of the patent drawings, for nesting and seating of the first outer row 261 of diamonds 102, 104, 106 and 108 on the first upper crossbar 240 within seats 262, 264, 266 and 268, respectively. Then the jeweler slightly bends each of the upper ends 304 and 314 of prong holding members 302 and 312 inwardly to engage diamonds 102 and 108, respectively, such that the retaining wall members 306 and 308 of prong 302 are adjacent to and in contact with the side walls 102*a* and 102*b* of diamonds 102. Also, the retaining wall members 316 and 318 of prong 312 are adjacent to and in contact with the side walls 108*a* and 108*b* of diamond 108 for securely holding in place diamonds 102 and 108 within seats 262 and 268 of the first outer row 261, respectively, of gemstone setting 200.

The jeweler again repeats the aforementioned steps for diamonds 118, 120, 122 and 124 by slidably setting the grooved slots 118*e*, 120*e*, 122*e* and 124*e* in diamonds 118, 120, 122 and 124, respectively, onto the first retaining insert edge member 254 of the second upper crossbar 250, as depicted in FIGS. 11 and 17 of the patent drawings, for nesting and seating of the second outer row 277 of diamonds 118, 120, 122 and 124 on the second upper crossbar 250 within seats 278, 280, 282 and 284, respectively. Then the jeweler slightly bends inwardly each of the upper ends 324 and 334 of prong holding members 320 and 332, respectively, such that the retaining wall members 326 and 328 of prong 322 are adjacent to and in contact with side walls 124*a* and 124 of diamond 124. Also, the retaining wall members 336 and 338 of prong 332 are adjacent to and in contact with the side walls 118*a* and 118*b* of diamond 118 for securely holding in place diamonds 118 and 124 within seats 278 and 284 of the second outer row 277, respectively, of gemstone setting 100.

The jeweler's final step is to attach the connecting bar member 340 to a clasp holding member 114 to form a clasp jewelry product, as shown in FIG. 18 of the drawings.

ADVANTAGES OF THE PRESENT INVENTION

Accordingly, an advantage of the present invention is that it provides for a multi-stone setting for holding therein nine or twelve rectangular-shaped or square-shaped gemstones in which the combined aggregate of the nine or twelve gemstones give a larger appearance than that of a single gemstone of a similar carat weight.

Another advantage of the present invention is that it provides for a multi-stone setting having nine or twelve gemstones therein that is less expensive than a single gemstone of a similar carat weight.

Another advantage of the present invention is that it provides for a multi-stone setting having nine or twelve princess cut gemstones therein which gives the appearance that the setting is substantially invisible at distances greater than 12 inches from the jewelry product.

Another advantage of the present invention is that it provides for a multi-stone setting that can be varied in size depending upon the total combined carat weight of the nine or twelve gemstones within the setting.

Another advantage of the present invention is that it provides for a multi-stone setting that can be made from precious metals such as gold, silver, platinum or palladium for setting precious gemstones including diamonds, rubies, sapphires, emeralds and the like.

Another advantage of the present invention is that it provides for a multi-stone setting having nine or twelve gemstones therein for use in personal adornment in the form of ornamental jewelry such as rings, pins, brooches, pendants, clasps, necklaces, bracelets, anklets and earrings.

Another advantage of the present invention is that it provides for a multi-stone setting that can be produced in an economical manner and is readily affordable by the jewelry consumer.

A latitude of modification, change, and substitution is intended in the foregoing disclosure, and in some instances, some features of the invention will be employed without a corresponding use of other features. Accordingly, it is appropriate that the appended claims be construed broadly and in a manner consistent with the spirit and scope of the invention herein.

What is claimed is:

1. A multi-stone setting having nine gemstones or diamonds, comprising:

a) a rectangular-shaped setting having a first lower crossbar extending in a first direction and a second lower crossbar being parallel and in the same plane to said first lower crossbar and also extending in said first direction;

b) said rectangular-shaped setting also having a first upper crossbar having first insert means extending in a second direction perpendicular to said first direction and a second upper crossbar having second insert means being parallel and in the same plane to said first upper crossbar and also extending in said second direction; said first and second lower crossbars being located in a different plane than said first and second upper crossbars;

c) said first and second lower crossbars and said first and second upper crossbars forming nine seats each for receiving one of nine gemstones or diamonds; said first and second lower crossbars and said first and second upper crossbars defining two outer rows of seats to form six outer seats and one inner row of three seats for receiving said nine gemstones, said six outer seats having four outer corner seats, to form a first outer row of gemstones, a second outer row of gemstones, and an inner row of gemstones, and said first and second outer rows of gemstones forming four outer corner gemstones, each of said four outer corner gemstones having side walls;

d) said first outer row of gemstones having a first set of inner side walls for engaging said first upper crossbar, said first set of inner side walls having grooves formed therein for seating said first outer row of gemstones on said first insert means of said first upper crossbar;

e) said second outer row of gemstones having a second set of inner side walls for engaging said second upper crossbar, said second set of inner side walls having grooves formed therein for seating said second outer row of gemstones on said second insert means of said second upper crossbar;

f) said inner row of gemstones having first inner side walls for engaging said first upper crossbar and second inner side walls for engaging said second upper crossbar; said first and second inner side walls having grooves formed therein for seating said inner row of gemstones on said first and said second insert means of said first and second upper crossbars, respectively;

g) said setting having four corners with four corner prongs mounted on said four corners, respectively; and h) each of said four corner prongs having a V-shaped configuration forming a right angle for engaging two side walls of one of said four outer gemstones in said first and second outer rows of gemstones; and i) said four V-shaped corner prongs engaging said four outer corner gemstones respectively to keep said four outer corner gemstones seated within said four outer corner seats of said setting.

2. A multi-stone setting in accordance with claim 1, wherein said rectangular-shaped setting is square-shaped.

3. A multi-stone setting in accordance with claim 1, wherein said rectangular-shaped setting includes a four-sided frame having four side frame members, said first and second lower crossbars being connected to two opposing side frame members, said first and second upper crossbars being mounted on top of said first and second lower crossbars and being connected to the other two opposing side frame members for forming said nine seats, said nine seats each having a rectangular shape.

4. A multi-stone setting in accordance with claim 3, wherein said nine seats each have a square shape.

5. A multi-stone setting in accordance with claim 3, wherein said four corner prongs each have upper ends, and wherein the upper ends of said four corner prongs are higher than said four side frame members for directly engaging the side walls of said four outer gemstones.

6. A multi-stone setting in accordance with claim 1, wherein said four corner prongs curve inwardly and are joined together at a bottom end point.

7. A multi-stone setting in accordance with claim 6, wherein said bottom end point is integrally attached to a connecting bar member for attachment to a jewelry holding member for forming a piece of jewelry.

8. A multi-stone setting in accordance with claim 7, wherein said connecting bar member is used with a jewelry holding member to form a ring, a pin, a brooch, a pendant, a clasp, a necklace, a bracelet, an anklet or earrings.

9. A multi-stone setting in accordance with claim 1, wherein said multi-stone setting can be made from gold, silver, platinum, palladium, or other precious metals.

10. A multi-stone setting in accordance with claim 1, wherein said multi-stone setting can be made into different size settings based upon the weight of the nine gemstones, wherein said weight is in the range 0.27 to 3.0 carats.

11. A multi-stone setting having twelve gemstones or diamonds, comprising:

a) a rectangular-shaped setting having a first lower crossbar extending in a first direction; a second lower crossbar being parallel and in the same plane to said first lower crossbar and also extending in said first direction; and a third lower crossbar being parallel and in the same plane to said first and second lower crossbars and also extending in said first direction;

b) said rectangular-shaped setting also having a first upper crossbar having first insert means extending in a second direction perpendicular to said first direction and a second upper crossbar having second insert means being parallel and in the same plane to said first upper crossbar and also extending in said second direction; said first, second and third lower crossbars being located in a different plane than said first and second upper crossbars;

c) said first, second and third lower crossbars and said first and second upper crossbars forming twelve seats each for receiving one of twelve gemstones or diamonds; said first, second and third lower crossbars and said first and second upper crossbars defining two outer rows of seats to form eight outer seats and one inner row of four seats for receiving said twelve gemstones, said eight outer seats having four outer corner seats, to form a first outer row of gemstones, a second outer row of gemstones, and an inner row of gemstones, and said first and second outer rows of gemstones forming four outer corner gemstones, each of said four outer corner gemstones having side walls;

d) said first outer row of gemstones having a first set of inner side walls for engaging said first upper crossbar, said first set of inner side walls having grooves formed therein for seating said first outer row of gemstones on said first insert means of said first upper crossbar;

e) said second outer row of gemstones having a second set of inner side walls for engaging said second upper crossbar, said second set of inner side walls having grooves formed therein for seating said second outer row of gemstones on said second insert means of said second upper crossbar;

f) said inner row of gemstones having first inner side walls for engaging said first upper crossbar and second inner side walls for engaging said second upper crossbar; said first and second inner side walls having grooves formed therein for seating said inner row of gemstones on said first and said second insert means of said first and second upper crossbars, respectively;

g) said setting having four corners with four corner prongs mounted on said four corners, respectively; and h) each of said four corner prongs having a V-shaped configuration forming a right angle for engaging two side walls of one of said four outer gemstones in said first and second outer rows of gemstones; and i) said four V-shaped corner prongs engaging said four outer corner gemstones respectively to keep said four outer corner gemstones seated within said four outer corner seats of said setting.

12. A multi-stone setting in accordance with claim 11, wherein said rectangular-shaped setting includes a four-sided frame having four side frame members, said first, second and third lower crossbars being connected to two opposing side frame members, said first and second upper crossbars being mounted on top of said first, second and third lower crossbars and being connected to the other two opposing side frame members for forming twelve seats, said twelve seats each having a rectangular shape.

13. A multi-stone setting in accordance with claim 12, wherein said twelve seats each have a square shape.

14. A multi-stone setting in accordance with claim 12, wherein said four corner prongs each have upper ends, and wherein the upper ends of said four corner prongs are higher than said four side frame members for directly engaging the side walls of said four outer gemstones.

15. A multi-stone setting in accordance with claim 11, wherein said four corner prongs curve inwardly and are joined together at a bottom end point.

16. A multi-stone setting in accordance with claim 15, wherein said bottom end point is integrally attached to a connecting bar member for attachment to a jewelry holding member for forming a piece of jewelry.

17. A multi-stone setting in accordance with claim 16, wherein said connecting bar member is used with a jewelry holding member to form a ring, a pin, a brooch, a pendant, a clasp, a necklace, a bracelet, an anklet or earrings.

18. A multi-stone setting in accordance with claim 11, wherein said multi-stone setting can be made from gold, silver, platinum, palladium, or other precious metals.

19. A multi-stone setting in accordance with claim 11, wherein said multi-stone setting can be made into different size settings based upon the weight of the twelve gemstones, wherein said weight is in the range 0.36 to 4.0 carats.

20. A multi-stone setting in accordance with claim 11, wherein said rectangular-shaped setting is square-shaped.

* * * * *